US006976767B1

(12) United States Patent
Lin

(10) Patent No.: US 6,976,767 B1
(45) Date of Patent: Dec. 20, 2005

(54) ILLUMINATION DEVICE HAVING ENHANCED ILLUMINATING EFFECT

(76) Inventor: Tung Hsiung Lin, No. 1, Alley 16, Lane 40, Jiun Te Rd, Taichung (TW)

( * ) Notice: Subject to any disclaimer, the term of this patent is extended or adjusted under 35 U.S.C. 154(b) by 55 days.

(21) Appl. No.: 10/755,802

(22) Filed: Jan. 9, 2004

(51) Int. Cl.[7] ..... F21S 4/00
(52) U.S. Cl. ..... 362/225; 362/347; 362/252
(58) Field of Search ..... 362/216–217, 362/225, 347; D26/3, 42, 79

(56) References Cited

U.S. PATENT DOCUMENTS 4,254,449 A * 3/1981 Benasutti et al. ..... 362/33
5,221,139 A * 6/1993 Belfer ..... 362/225
D347,076 S * 5/1994 DeKleine et al. ..... D26/3
D348,528 S * 7/1994 DeKleine et al. ..... D26/3
2001/0055204 A1 * 12/2001 Misuteru ..... 362/27

* cited by examiner

*Primary Examiner*—Ali Alavi
(74) *Attorney, Agent, or Firm*—Pro-Techtor Int'l Services

(57) ABSTRACT

An illumination device includes a plurality of light tubes arranged in a substantially V-shaped manner, and at least one reflector located adjacent to the light tubes. The reflector has a semi-circular shape directed in an axial direction of the light tubes. Thus, the light reflected from the reflector is not directed toward the incident direction of the light tubes, so that the light reflected from the reflector is projected outward in a straight manner without being blocked and sheltered by the light tubes, thereby decreasing the optical loss to the minimum.

12 Claims, 19 Drawing Sheets

ILLUMINATION DEVICE HAVING ENHANCED ILLUMINATING EFFECT

BACKGROUND OF THE INVENTION

1. Field of the Invention

The present invention relates to an illumination device, and more particularly to an illumination device having an enhanced illuminating effect.

2. Description of the Related Art

A conventional lamp comprises a base, and a plurality of U-shaped light tubes attached on the base and arranged in an annular manner. However, the light from the central part of the light tubes of the conventional lamp cannot be projected outward efficiently, thereby decreasing the illumination effect of the conventional lamp. In addition, the lighting area and brightness of the conventional lamp are also limited.

SUMMARY OF THE INVENTION

The primary objective of the present invention is to provide an illumination device that can greatly enhance the effect of concentration and expansion of light.

Another objective of the present invention is to provide an illumination device that forms a substantially V-shaped light base to increase the illumination efficiency.

A further objective of the present invention is to provide an illumination device that can achieve the energy-saving effect.

A further objective of the present invention is to provide an illumination device, wherein the light reflected from the reflector is not directed toward the incident direction of the light tubes, so that the light reflected from the reflector is projected outward in a straight manner without being blocked and sheltered by the light tubes, thereby decreasing the optical loss to the minimum.

A further objective of the present invention is to provide an illumination device, wherein the connector is combined with two tube units, with the plug of each of the two tube units being inserted into the connector, so that the light tubes are combined to form a substantially X-shaped light source to achieve an illumination effect of 360 degrees, without needing-to-provide the reflector.

A further objective of the present invention is to provide an illumination device, wherein the V-shaped arranged light tubes have a light concentration effect, so that the light of the light tubes is entirely directed toward the opened side of the V-shaped arrangement, thereby enhancing the illuminance.

A further objective of the present invention is to provide an illumination device, wherein the V-shaped arranged light tubes co-operate with the semi-circular reflector to dissipate the heat produced from the light tubes rapidly.

In accordance with the present invention, there is provided an illumination device, comprising:

a plurality of light tubes arranged in a substantially V-shaped manner; and at least one reflector located adjacent to the light tubes, wherein:

the reflector has a semi-circular shape directed in an axial direction of the light tubes.

Further benefits and advantages of the present invention will become apparent after a careful reading of the detailed description with appropriate reference to the accompanying drawings.

DETAILED DESCRIPTION OF THE INVENTION

Figure 1:
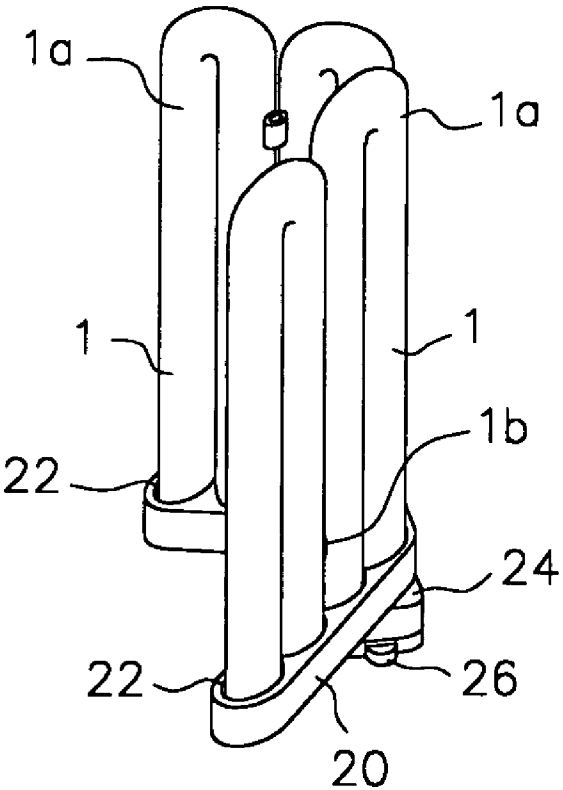
FIG. 1 is a perspective view of an illumination device in accordance with the preferred embodiment of the present invention.
Figure 2:
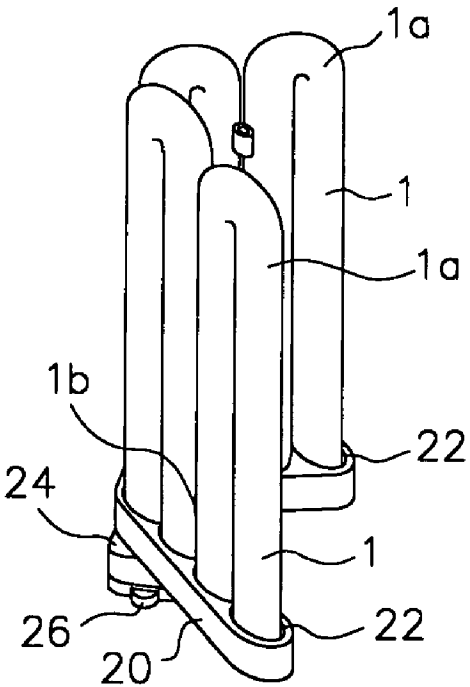
FIG. 2 is another perspective view of the illumination device in accordance with the preferred embodiment of the present invention.
Figure 3:
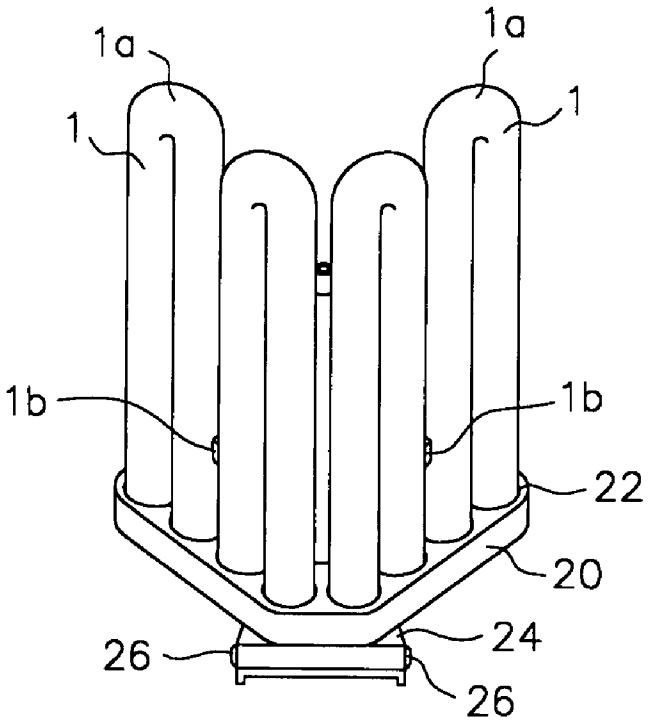
FIG. 3 is another perspective view of the illumination device in accordance with the preferred embodiment of the present invention.
Figure 4:
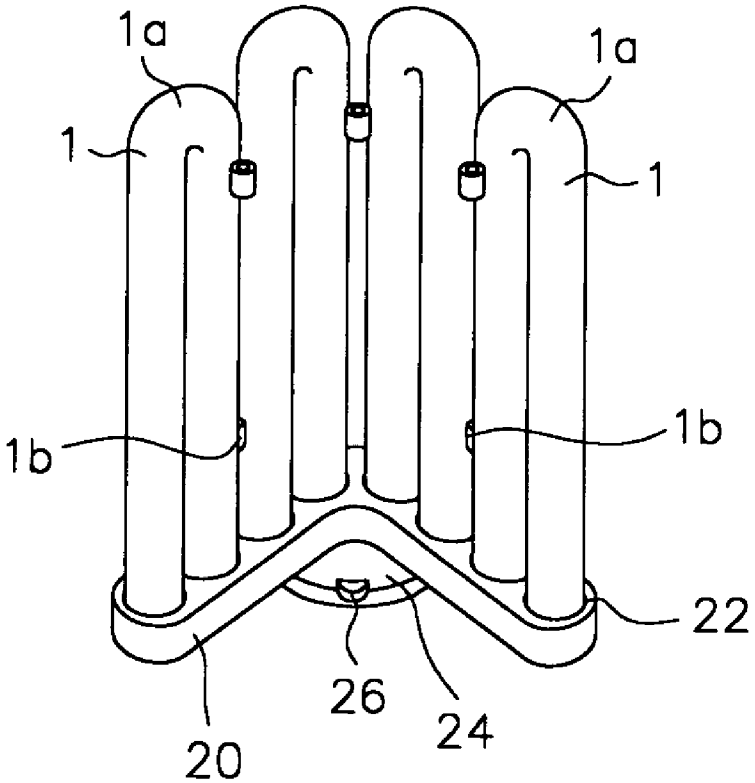
FIG. 4 is another perspective view of the illumination device in accordance with the preferred embodiment of the present invention.

Referring to the drawings and initially to FIGS. 1–8, an illumination device in accordance with the preferred embodiment of the present invention comprises a substantially V-shaped tube unit 2, a plurality of substantially inverted U-shaped light tubes 1 each mounted on the tube unit 2, and a plug-based connector 3 detachably mounted on the tube unit 2.

Each of the light tubes 1 includes two tube portions 1*a*. The light tubes 1 are connected by a plurality of connecting members 1*b*.

The tube unit 2 includes a substantially V-shaped support portion 20 having a first side for supporting the light tubes 1, a plurality of holders 22 mounted on the first side of the support portion 20 and locked on the light tubes 1 for holding the light tubes 1, and a substantially semi-cylindrical plug 24 mounted on a second side of the support portion 20 and having a periphery formed with a plurality of equally distant arc-shaped locking blocks 26. Preferably, the included angle of the V-shaped support portion 20 of the tube unit 2 is about from 90° to 135°.

The connector 3 is a substantially cylindrical-shaped body, and has a periphery formed with a plurality of equally distant arc-shaped channels 3*a*, and a plurality of locking sections 3*b* each located adjacent to a respective one of the channels 3*a* and each formed with a locking groove 3*c* communicating with the respective channel 3*a*.

Figure 5:
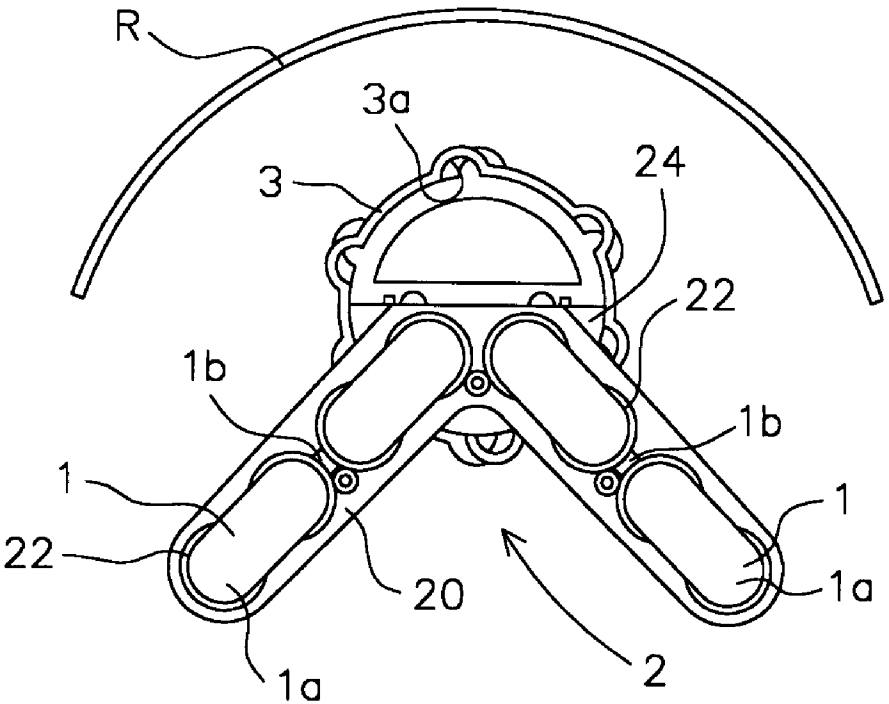
FIG. 5 is a top plan view of the illumination device in accordance with the preferred embodiment of the present invention.
Figure 9:
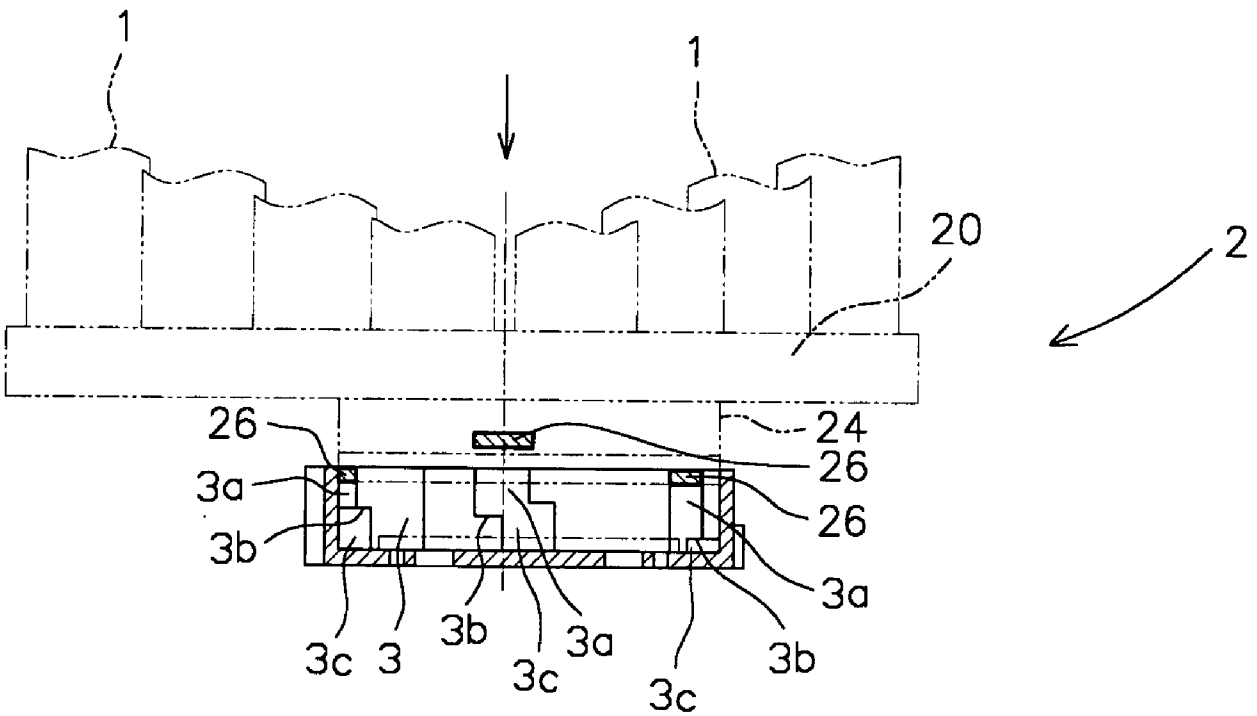
FIG. 9 is a plan cross-sectional assembly view of the illumination device in accordance with the preferred embodiment of the present invention.
Figure 10:
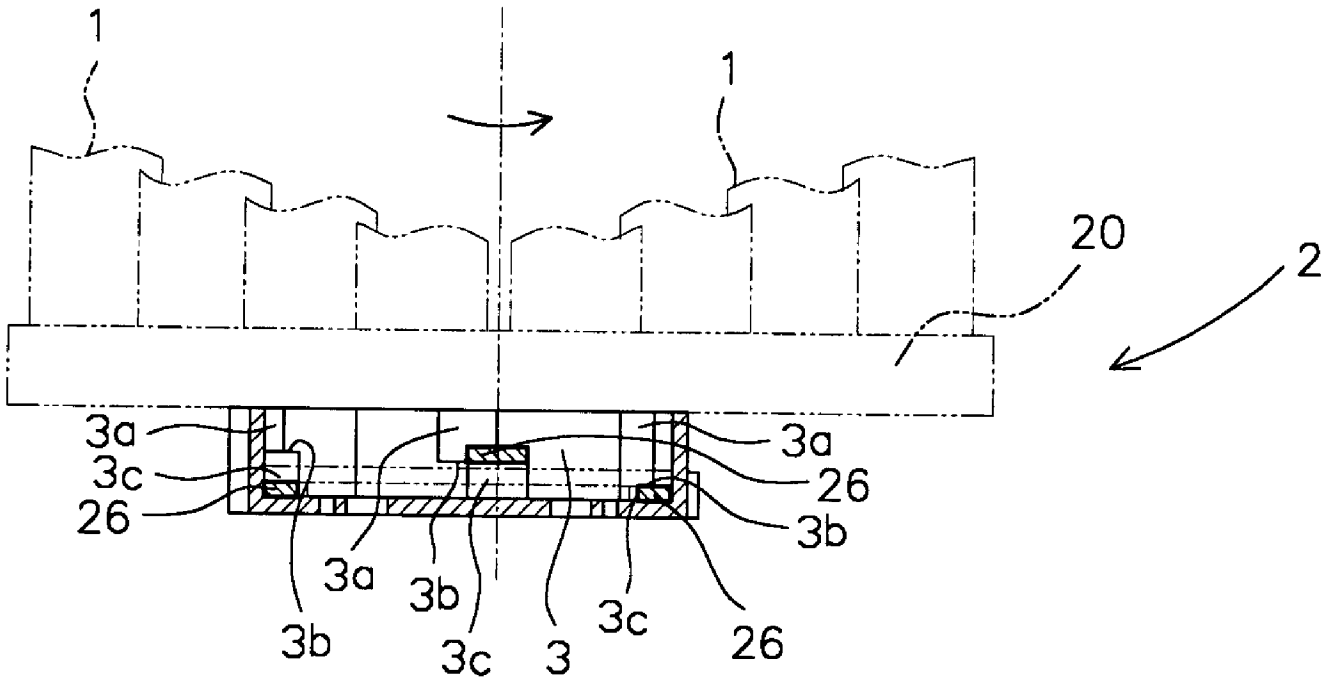
FIG. 10 is a schematic operational view of the illumination device as shown in FIG. 9.

Referring to FIGS. 9 and 10 with reference to FIGS. 1–8, when the plug 24 of the tube unit 2 is inserted into the connector 3, each of the locking blocks 26 of the plug 24 is inserted into a respective one of the channels 3*a* of the connector 3 as shown in FIG. 9. Then, the plug 24 of the tube unit 2 is rotated relative to the connector 3, so that each of the locking blocks 26 of the plug 24 is inserted into and locked in the locking groove 3*c* of a respective-one of the locking sections 3*b* of the connector 3 as shown in FIG. 10, thereby fixing the plug 24 of the tube unit 2 on the connector 3 as shown in FIG. 5. Thus, the tube unit 2 is combined with the connector 3 rigidly and stably without detachment. In such a manner, the connector 3 is built in a socket (not shown) of a power supply (not shown), so that the plug 24 of the tube unit 2 is electrically connected to the power supply.

Figure 6:
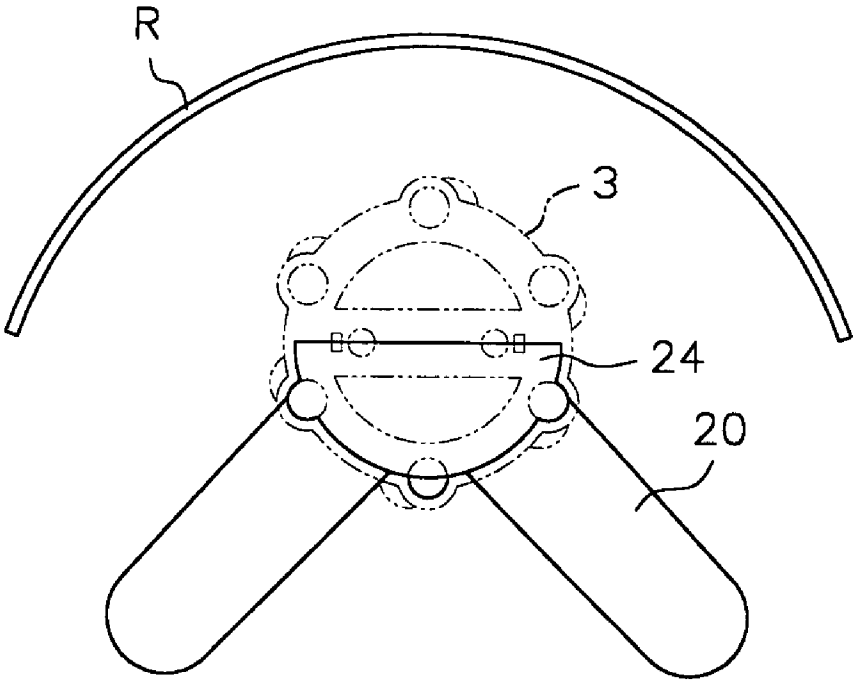
FIG. 6 is a bottom plan view of the illumination device in accordance with the preferred embodiment of the present invention.
Figure 7:
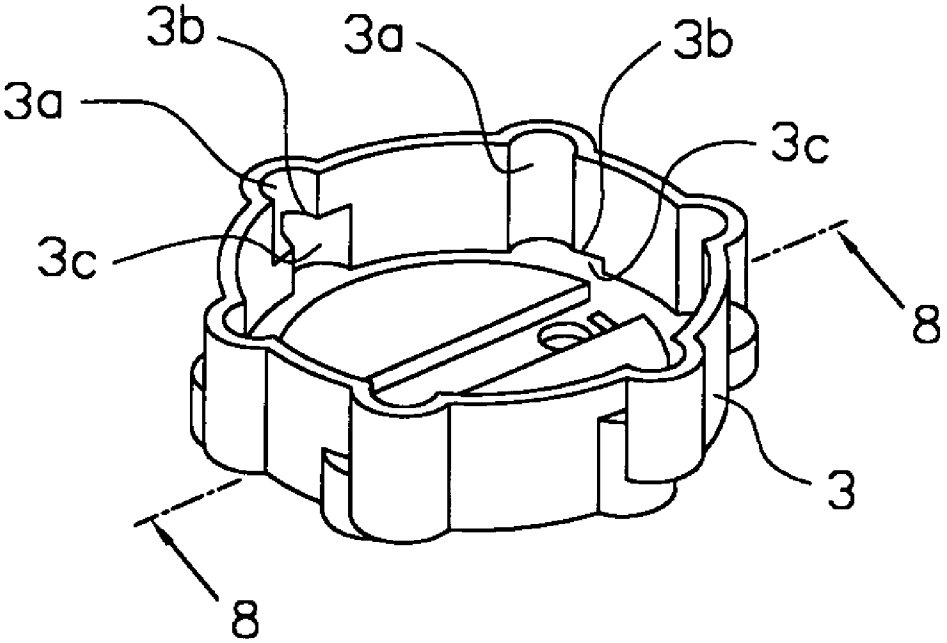
FIG. 7 is a perspective view of a connector of the illumination device in accordance with the preferred embodiment of the present invention.
Figure 8:
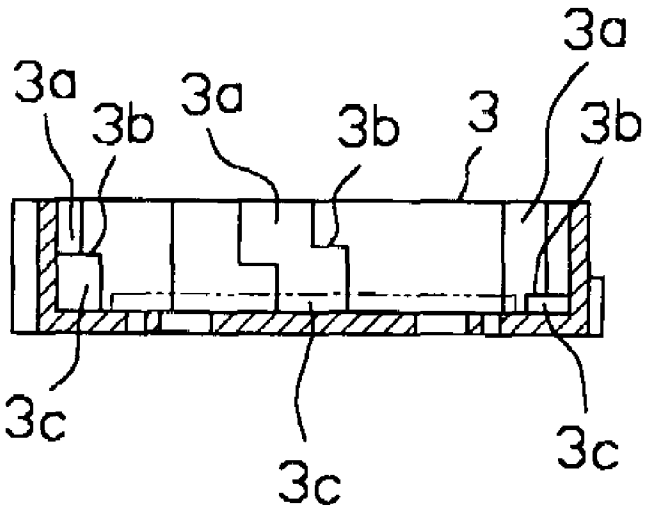
FIG. 8 is a plan cross-sectional view of the connector of the illumination device as shown in FIG. 7.

Referring to FIGS. 5 and 6, the illumination device is located adjacent to a semi-circular reflector R which is mounted on a ceiling (not shown) and flush with the periphery of the ceiling. The convex portion of the tube unit 2 of the illumination device is directed toward the reflector R. In such a manner, the light reflected from the reflector R is not directed toward the incident direction of the light tubes 1, so that the light reflected from the reflector R is projected outward in a straight manner without being blocked-and-sheltered by the light tubes 1, thereby decreasing the optical loss to the minimum.

Accordingly, the light tubes 1 are arranged in a substantially V-shaped manner, and are arranged in a parallel manner directed toward an axial direction thereof. In addition, the reflector R has a semi-circular shape directed in the axial direction of the light tubes 1. Further, the V-shaped arranged light tubes 1 have a light concentration effect, so that the light of the light tubes 1 is entirely directed toward the opened side of the V-shaped arrangement, thereby enhancing the illuminance. Further, the V-shaped arranged light tubes 1 co-operate with the semi-circular reflector R to dissipate the heat produced from the light tubes 1 rapidly.

Figure 11:
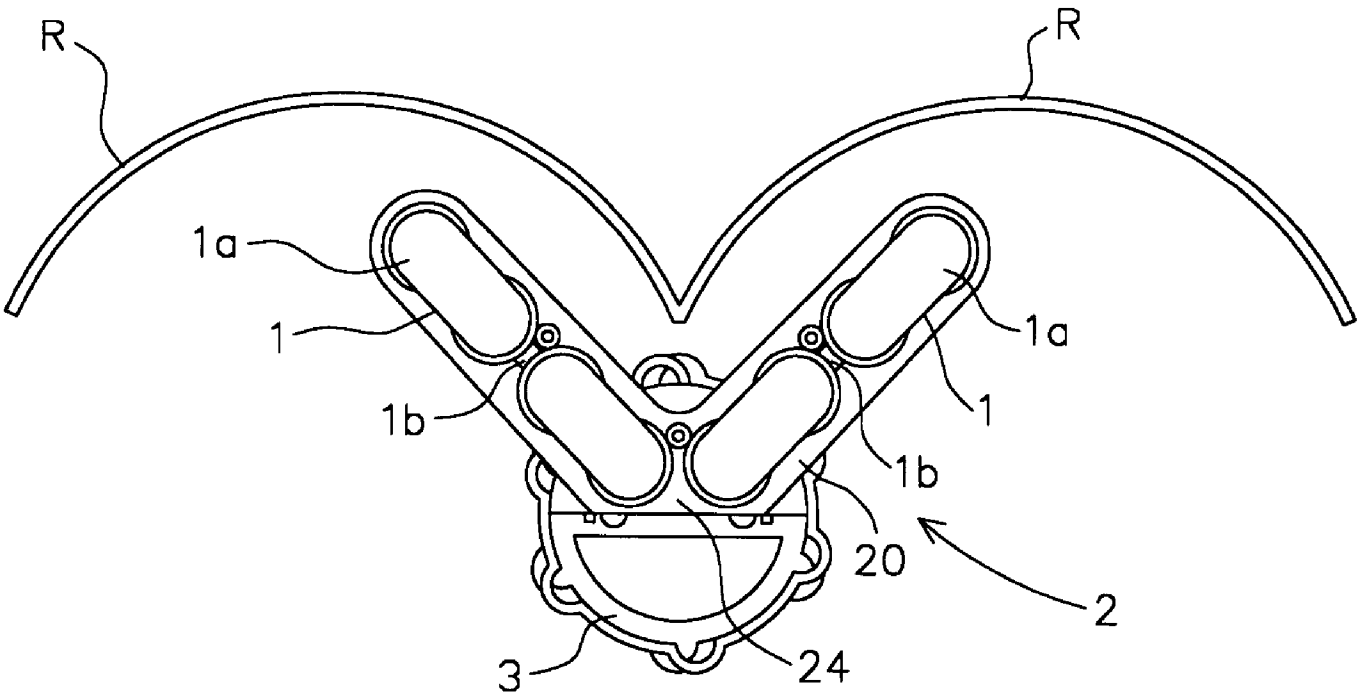
FIG. 11 is a top plan view of an illumination device in accordance with another embodiment of the present invention.
Figure 12:
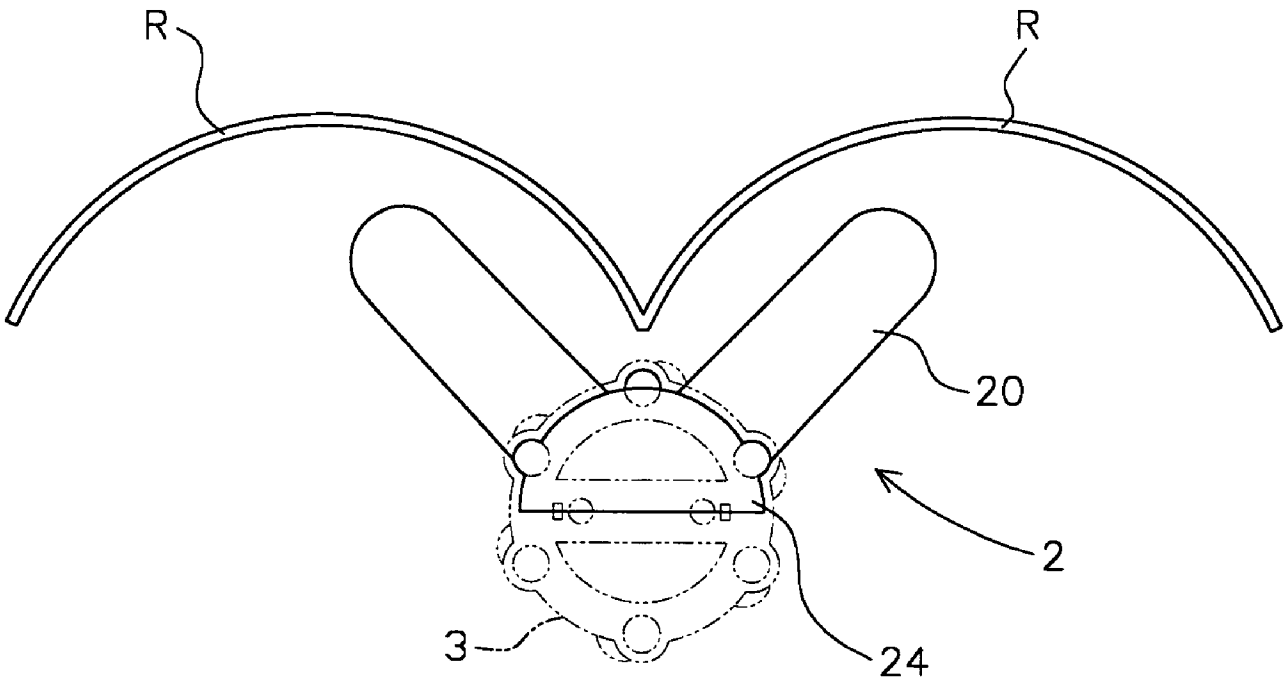
FIG. 12 is a bottom plan view of the illumination device as shown in FIG. 11.

Referring to FIGS. 11 and 12, the illumination device is located adjacent to two semi-circular reflectors R, with the concave portion of the tube unit 2 of the illumination device being directed-toward the reflectors R.

Figure 13:
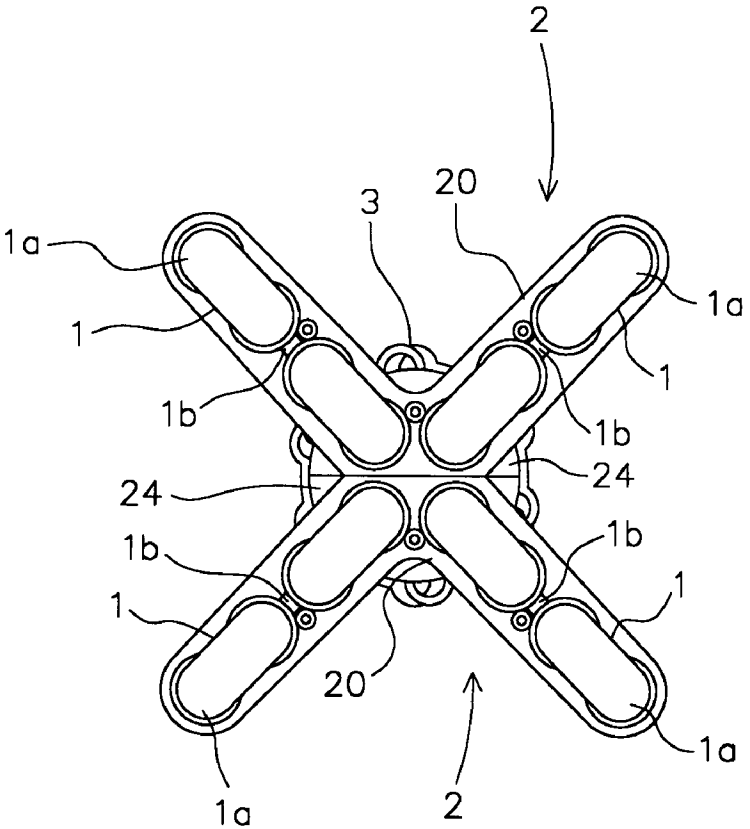
FIG. 13 is a top plan view of an illumination device in accordance with another embodiment of the present invention.
Figure 14:
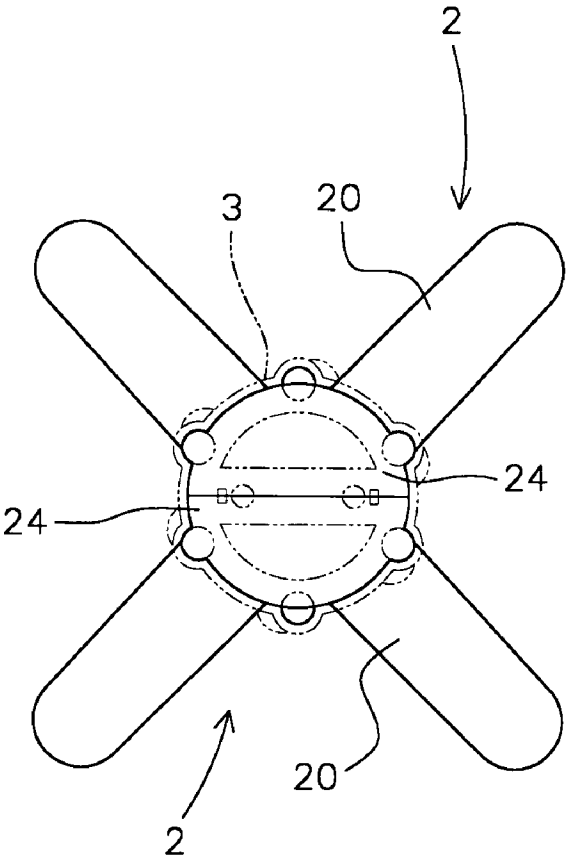
FIG. 14 is a bottom plan view of the illumination device as shown in FIG. 13.
Figure 15:
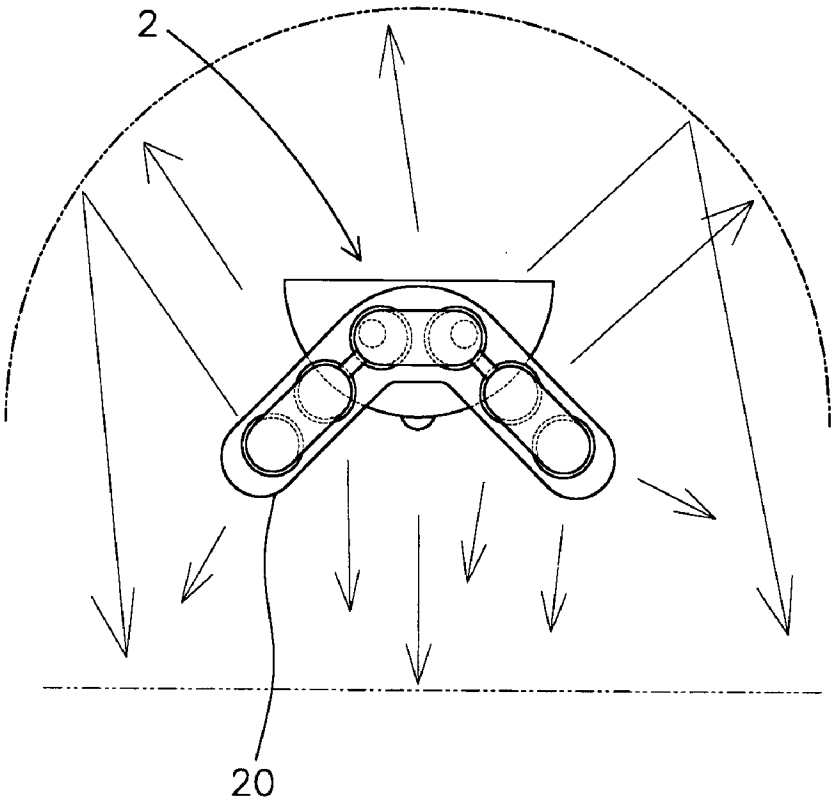
FIG. 15 is a top plan operational view of an illumination device in accordance with another embodiment of the present invention.
Figure 16:
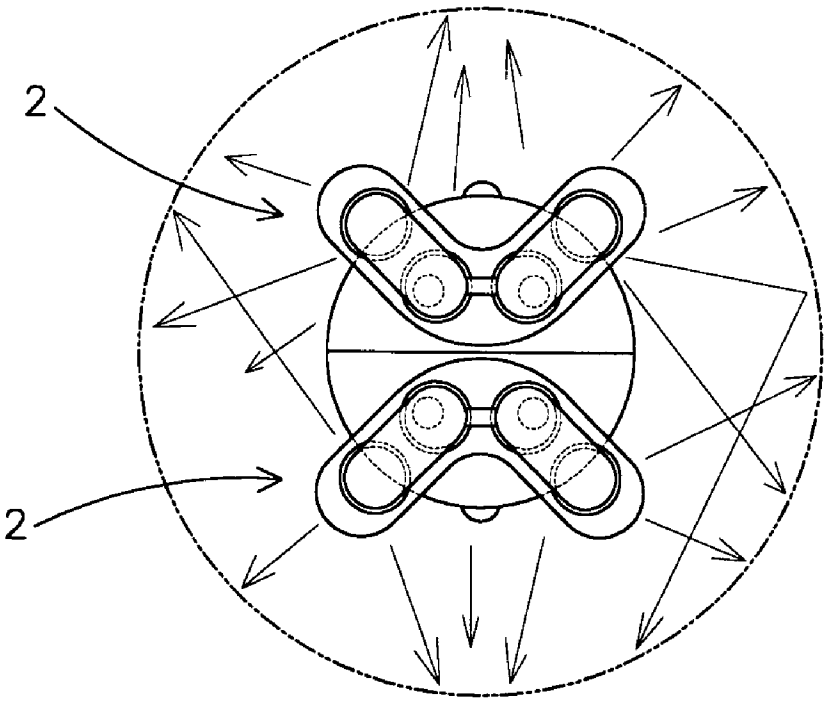
FIG. 16 is a top plan operational view of an illumination device in accordance with another embodiment of the present invention.
Figure 17:
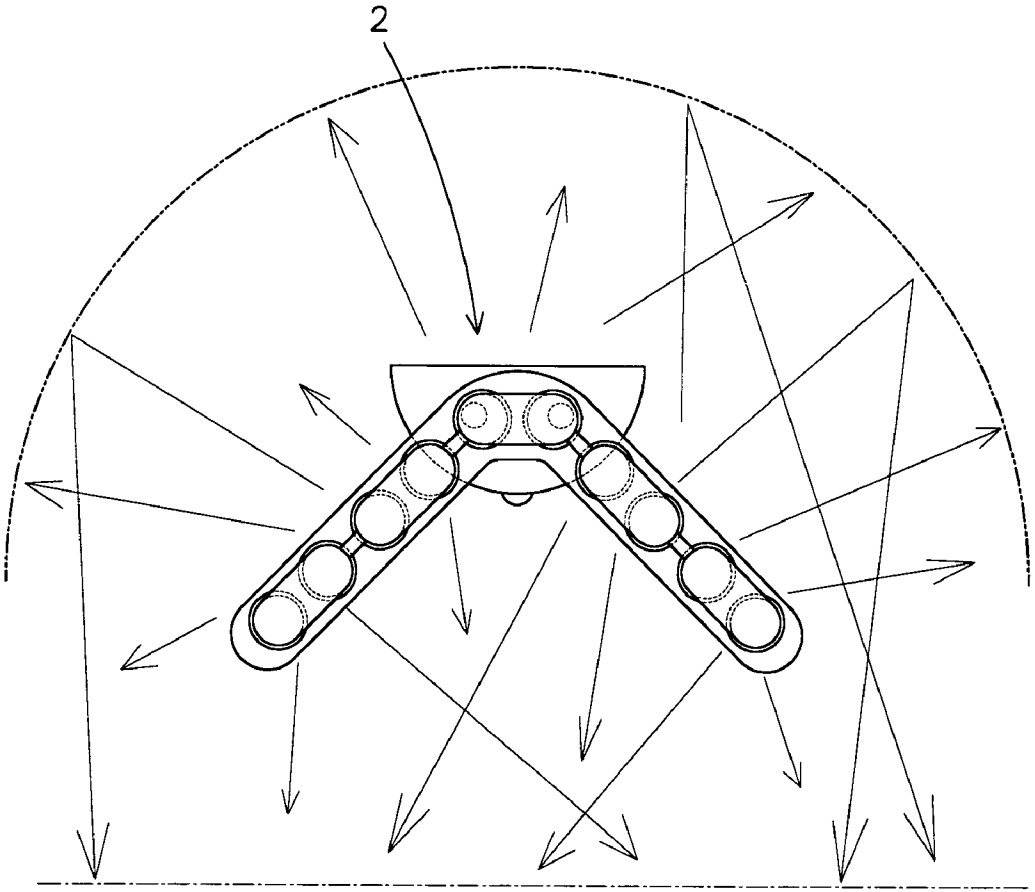
FIG. 17 is a top plan operational view of an illumination device in accordance with another embodiment of the present invention.
Figure 18:
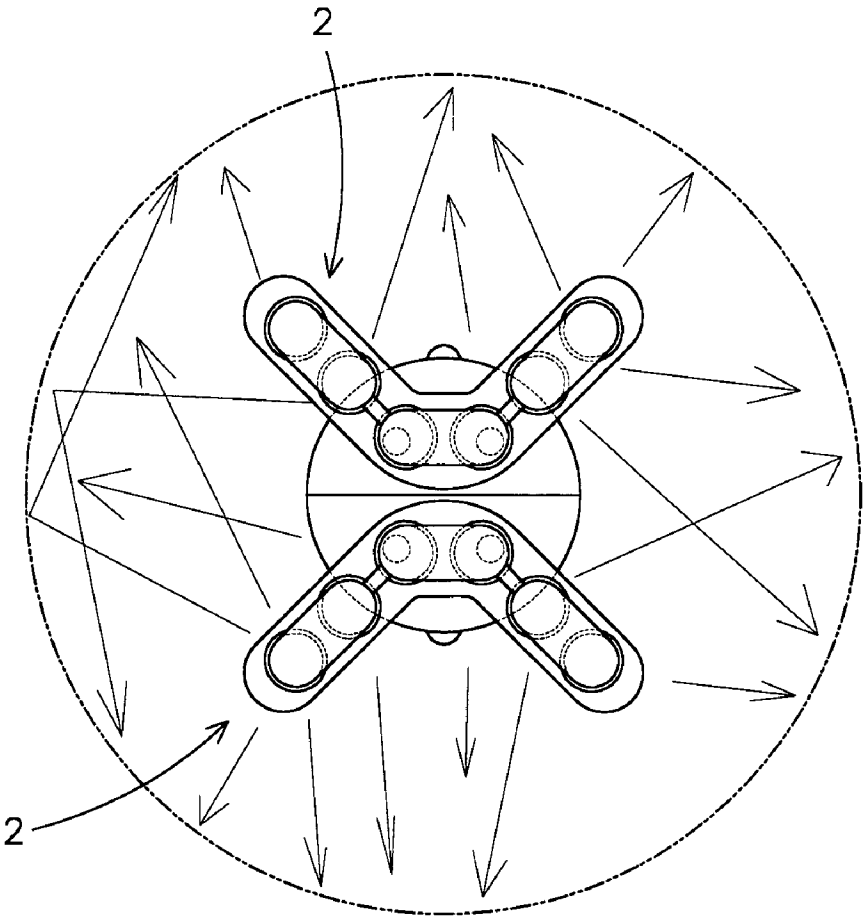
FIG. 18 is a top plan operational view of an illumination device in accordance with another embodiment of the present invention.
Figure 19:
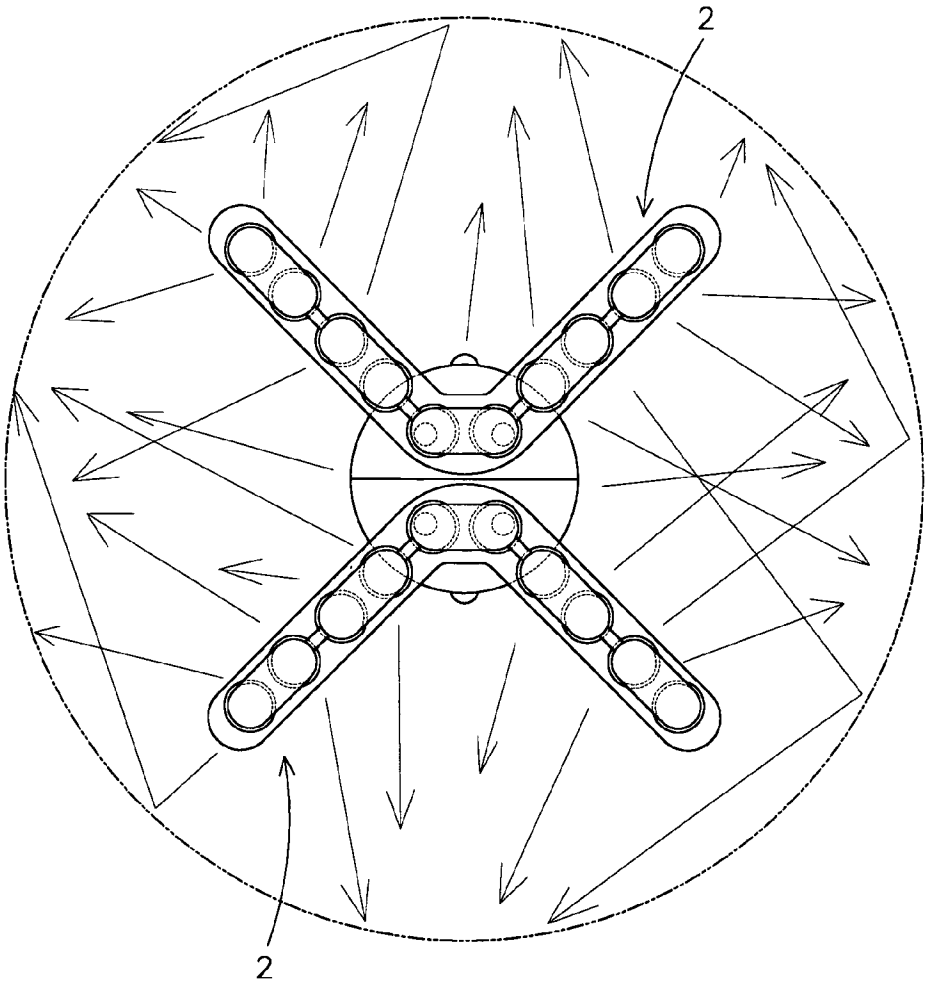
FIG. 19 is a top plan operational view of an illumination device in accordance with another embodiment of the present invention.

Referring to FIGS. 13 and 14, the connector 3 is combined with two tube units 2, with the plug 24 of each of the two tube units 2 being inserted into the connector 3, so that the light tubes 1 are combined to form a substantially X-shaped light source to achieve an illumination effect of 360 degrees, without needing, to provide the reflector R.

Referring to FIGS. 15–19, the illumination device has various shapes, angles and modes, thereby enhancing the versatility of the illumination device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall-within the true scope of the invention.

What is claimed is:

1. An illumination device, comprising:

a tube unit having a substantial V-shaped support portion which has a first side mounted on a plurality of light tubes and a connector detachably mounted on the tube unit, the connector having a periphery formed with a plurality of arc-shaped channels and a plurality of locking sections each located adjacent to a respective one of the channels each locking section formed with a locking groove which is in communication with the respective channel, the tube unit including a plug mounted on a second side of the support portion and the plug having a periphery formed with a plurality of equally distant arc-shaped locking blocks, each of the arc-shaped locking blocks of the plug being inserted into a respective one of the channels of the connector and locked in the locking groove of a respective one of the locking sections of the connector so as to fix the plug of the tube unit on the connector, at least one reflector located adjacent to the light tubes and having a semi-circular shape directed in an axial direction of the light tubes.

2. The illumination device in accordance with claim 1, wherein the light tubes are arranged in a parallel manner directed toward the axial direction thereof.

3. The illumination device in accordance with claim 1, wherein each of the light tubes is substantially inverted U-shaped.

4. The illumination device in accordance with claim 1, wherein each of the light tubes includes two tube portions.

5. The illumination device in accordance with claim 1, wherein the light tubes are connected by a plurality of connecting members.

6. The illumination device in accordance with claim 1, wherein the tube unit further includes a plurality of holders mounted on the first side of the support portion and locked on the light tubes for holding the light tubes.

7. The illumination device in accordance with claim 1, wherein the V-shaped support portion of the tube unit has an included angle about from 90° to 135°.

8. The illumination device in accordance with claim 1, wherein the connector is a substantially cylindrical-shaped body.

9. The illumination device in accordance with claim 1, wherein the plug is a substantially semi-cylindrical body.

10. The illumination device in accordance with claim 1, wherein the connector is combined with two tube units, with the plug of each of the two tube units being inserted into the connector, so that the light tubes are combined to form a substantially X-shaped light source.

11. The illumination device in accordance with claim 1, wherein the tube unit has a convex portion directed toward the reflector.

12. The illumination device in accordance with claim 1, wherein the light tubes are located adjacent to two semi-circular reflectors, with a concave portion of the tube unit being directed toward the reflectors.

* * * * *